US005582295A

United States Patent [19]

Bryndle

[11] Patent Number: 5,582,295

[45] Date of Patent: Dec. 10, 1996

[54] PLACEMARK PACKAGE

[76] Inventor: Richard Bryndle, 2741 Caribbean Isle Blvd. Apartment No. 2514, Melbourne, Fla. 32935

[21] Appl. No.: 310,484

[22] Filed: Sep. 22, 1994

[51] Int. Cl.[6] ..... B65D 85/62

[52] U.S. Cl. ..... 206/447; 206/459.5; 206/460

[58] Field of Search ..... 206/447, 449, 206/450, 451, 459.5, 460; 40/359

[56] References Cited

U.S. PATENT DOCUMENTS

| | | | |
|---|---|---|---|
| 3,338,395 | 8/1967 | Silverstein | 206/460 |
| 3,945,559 | 3/1976 | Krautsack | 206/460 |
| 4,135,316 | 1/1979 | Saito | 206/459.5 |
| 4,662,528 | 5/1987 | Slat | 215/12 R |
| 5,361,904 | 11/1994 | Kapec et al. | 206/460 |

OTHER PUBLICATIONS

WESTflags–Create Your Own Indexing Flags the 1994 edition of *Federal Civil Judicial Prodecure and Rules.*

*Primary Examiner*—Jimmy G. Foster
*Attorney, Agent, or Firm*—Polster, Lieder, Woodruff & Lucchesi, LC

[57] ABSTRACT

A peel pad package is made up of a plurality of pads, each consisting of a multiplicity of sheets each of which has a strip of adhesive along an edge area, all of the pads being mounted on a backing sheet. The backing sheet itself has a strip of adhesive whereby the backing sheet can be mounted on a surface convenient to the place at which the sheets are to be used. The pads may be of the same or different sizes. The sheets of each pad are generally of the same color, but the colors of sheets of different pads may and preferably do differ. Preferably, at least some of the pads are made up of sheets large enough to be useful as placemarks, but small enough so that they do not get in one another's way when used on the margins of multiple pages. The strip of adhesive on these sheet is preferably narrow enough to fit between the margin of writing on a page or printing in a book, and the edge of the page. At least some of the pads can be of note size. The backing can be printed with indicia such as advertising or bits of wisdom, the pads being arranged to permit the indicia to be read. The backing can be provided with a perforate section or a plurality of perfoated sections each with adhesive on one side, so that the backing can easily be torn off from the strip. The strip can be imprinted to leave a message or identify a person, such as the owner of the object to which it is adhered.

10 Claims, 2 Drawing Sheets

PLACEMARK PACKAGE

BACKGROUND OF THE INVENTION

Pads of self-stick removable notes, sold under the trademark "Post-it", by 3M (Minnesota Mining & Manufacturing Co.) have become ubiquitous because of their usefulness. They are commonly used as place marks as well as media for writing. Each pad has a sheet of thin paper to which the bottom note is adhered, the sheet itself having no adhesive on its back surface. This type of pad is referred to herein, generically, as a peel pad.

One of the objects of this invention is to provide a package of peel pads in a form that makes the pads convenient and economical to use.

Another object is to provide such a package that can be mounted on a surface conveniently located with respect to the place at which the sheets making up the pads are to be used.

Other objects will become apparent to those skilled in the art in the light of the following description and accompanying drawing.

SUMMARY OF THE INVENTION

In accordance with this invention, generally stated, a peel pad package is provided that consists of a plurality of pads of self-adhering sheets or notes, the pads being mounted on a unitary backing. The pads on one backing may be of the same size or of various different sizes. Preferably, the sheets of various of the pads are of the same color throughout the pad, but of different colors from pad to pad, so that placemarks of different colors can be used to designate different topics or subjects. The backing itself is provided with one or more strips of adhesive, generally with a manually removable cover strip over each strip of adhesive, so that the entire assemblage can be adhered to a convenient surface. The adhesive can be of the same character as that of the pads, so that the backing can also be peeled off of the surface on which it is mounted, or it can be of a type that makes a more permanent bond. In the latter case, the backing can be made in such a way that, at one edge, successive strips of adhesive are defined by lines of weakness, such as perforations, so that if the pad is adhered to a surface, such as a book cover, by the outer-most of the adhesive strips, the strip can be separated from the backing by tearing along the perforation or line of weakness, leaving the strip in place. Such an arrangement can also be employed with peelable adhesive, if a strip is to be left on the surface, for example, to indicate that a book or study material has been used by a particular person whose name is on the strip. In either case, each of the strips may and preferably does have imprinted upon it, on the side opposite the adhesive, indicia of some sort, such as advertising or sayings or mottos or the name of the owner of the package or of the book or folder to which the package was adhered.

Of course, if the package is not intended to be removed, the adhesive can be strong, not peelable, applied to the backing and no provision made for removal of the package.

Although mounting the pads on only one side of the backing has advantages of simplicity and ease of use, pads can be mounted on both sides of the backing. The pads on the two sides can be the same, or they can be different; for example, small placemark tabs can be on one side, notes on the other.

The sheets that make up the pads can be paper, or they can be plastic, transparent, translucent, opaque or frosted in whole or in part, with or without emphasizing lines or arrows or other imprinting.

The pad sheets can serve as carriers for other tabs, such as folded tabs that are intended to engage both sides of a book page edge, for example. In that case, the sheets are coated with a silicone release agent, and the tabs can have lines of an adhesive that does not permit their being peeled off of a page to which the tab is applied, if that is desired.

DESCRIPTION OF THE PREFERRED EMBODIMENT

Figure 1:
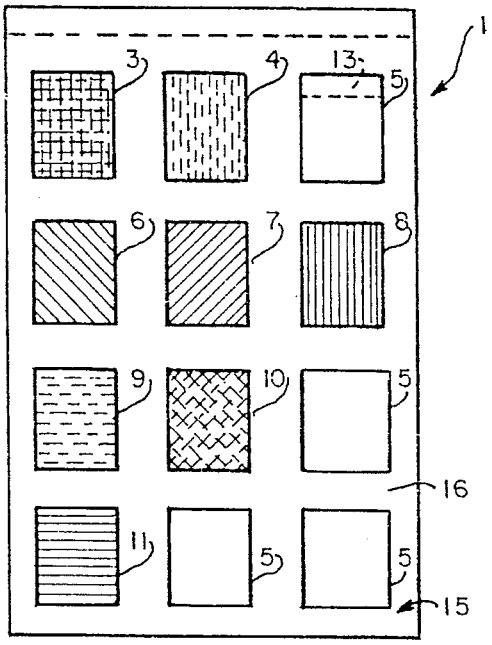
FIG. 1 is a view in front elevation of one embodiment of placemark package of this invention.
Figure 2:
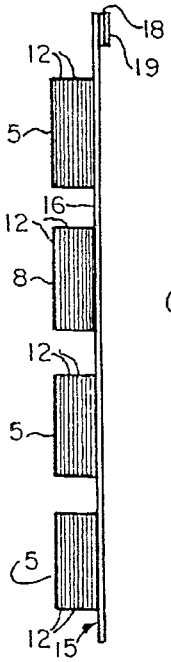
FIG. 2 is a view in side or edge elevation of the package of FIG. 1.
Figure 3:
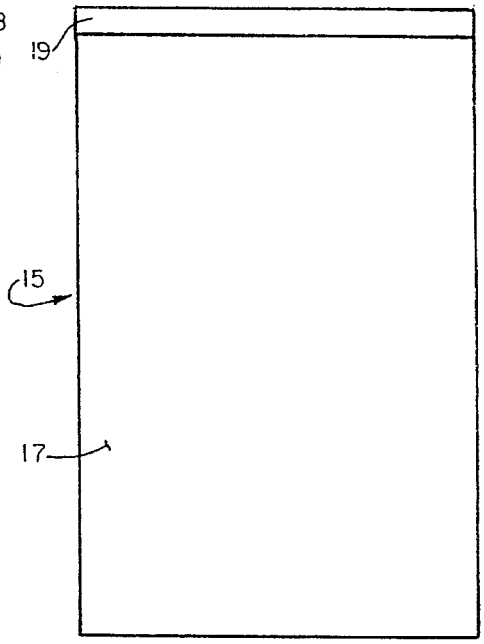
FIG. 3 is a view in rear elevation of the package shown in FIGS. 1 and 2.

Referring now to the drawings and particularly to FIGS. 1 through 3; reference numeral 1 indicates one embodiment of the package of this invention, in which pads 3 through 11 are mounted on one broad surface 16 of a backing 15. The backing 15 is a sheet of thin but self-supporting material, of the character of Bristle board or thin cardboard, for example. Along one edge of an opposite broad surface 17 of the backing 15, is a strip of adhesive 18, over which a cover strip 19 extends. The cover strip 19 is manually removable from the adhesive surface 18, and the adhesive 18 can then be made to adhere to a surface that is convenient to the user of the pads.

In this embodiment, the pads are shown as being of different colors. Merely for illustrative purposes, the pads are shown as being in nine different colors, including the white pads 5. However, they may be made in as many or as few different colors as is desired, depending upon how sheets or notes 12, making up the pads, are to be used.

The pads shown in this embodiment are preferably no larger than ¾" by ⅞", ideally, not larger than ½" by ⅝"; and an adhesive area on the back of each of the sheets 12, as indicated in dotted lines on one of the pads 5, is preferably no more than ⅝", ideally, no wider than ⅜". The reason for these dimensions is that the notes or sheets are designed to protrude in their long dimension from a book or paper far enough to be seen, but not unnecessarily far, to be of a width so as not to overlap unnecessarily on successive places that are being marked, and to adhere between the margin of printed matter and the edge of the book or paper, but not to leave an exposed area of adhesive beyond the margin. Of course, for other purposes, the dimensions can be modified.

Figure 4:
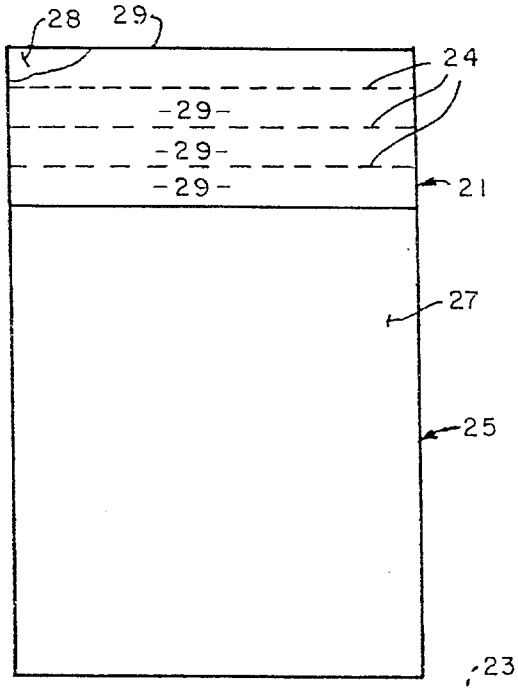
FIG. 4 is a view in rear elevation of yet another embodiment of placemark package of this invention.
Figure 6:
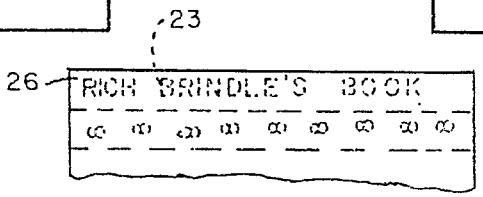
FIG. 6 is a view in front elevation of the package of FIG. 4.

Referring now to FIGS. 4 and 6, a package 21 is shown, a rear broad surface 27 of a sheet of backing 25 of which is shown as perforated along lines 24, to define areas that are covered with adhesive 28 overlain by individual cover strips 29. The backing 25 can be of any tearable material, and may be stiff or flexible.

Figure 13:
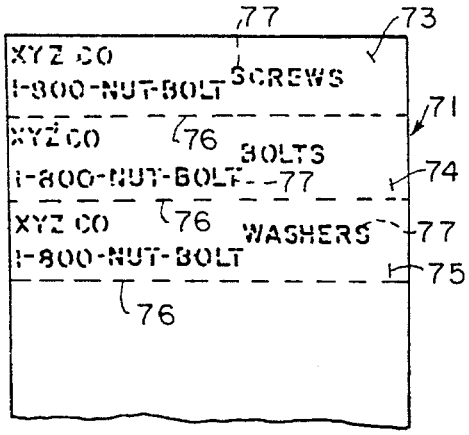
FIG. 13 is a fragmentary view in front elevation illustrating strips of backing separated by perforations, bearing indicia, which can, for example, be part of the package shown in FIGS. 7–9.

Preferably, the strips between the perforations 24 have indicia 23 on surfaces 26 on the broad side of the sheet 25 opposite the adhesive 28 and cover strips 29 as shown in FIG. 13. In use, this embodiment of pad can be adhered to a cover or the frontispiece of a book, for example, by stripping the upper-most of the cover strips 29 from its corresponding section, exposing the adhesive 28, and pressing the adhesive side against the surface to which it is to be mounted. When it is desired to remove the package, the adhered strip can be permitted to remain in place, and the package separated by tearing along the line of perforations 24 contiguous the strip, leaving the strip with its indicia in place. The indicia can be in the form of an identification or book plate, a saying of some sort, or decoration, for example.

Figure 5:
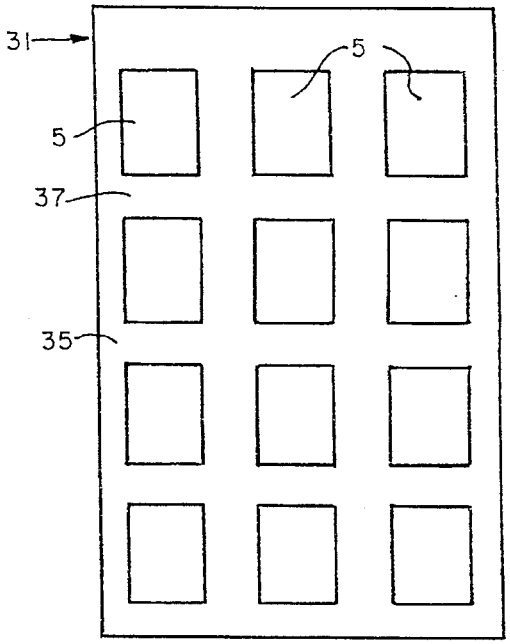
FIG. 5 is a view in front elevation of a third embodiment of a smart package of this invention.

Referring to FIG. 5, a third embodiment is shown. In this embodiment, a package 31 consists of a self-supporting backing 35 on which pads 5 are mounted on a front surface 37. In this embodiment, no adhesive or cover strip is applied to the opposite side of the backing, so that in rear elevation it looks like the package of FIG. 3, but without the cover strip 19 or adhesive 18. In this embodiment, the pads 5 can be colored in any of the ways in which the pads 3, 4, and 6 through 11 of FIG. 1 are colored.

Figure 7:
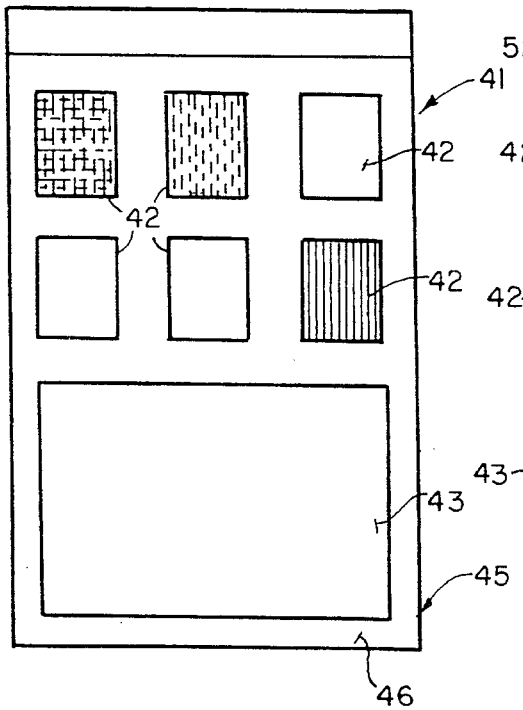
FIG. 7 is a view in rear elevation of another embodiment of package.
Figure 8:
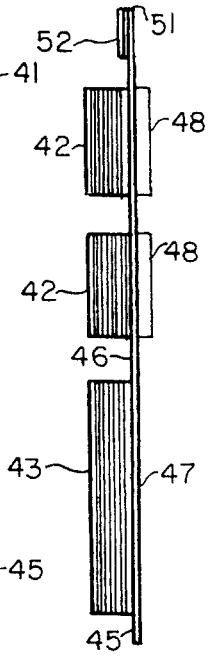
FIG. 8 is a view in edge elevation of the package of FIG. 7.
Figure 9:
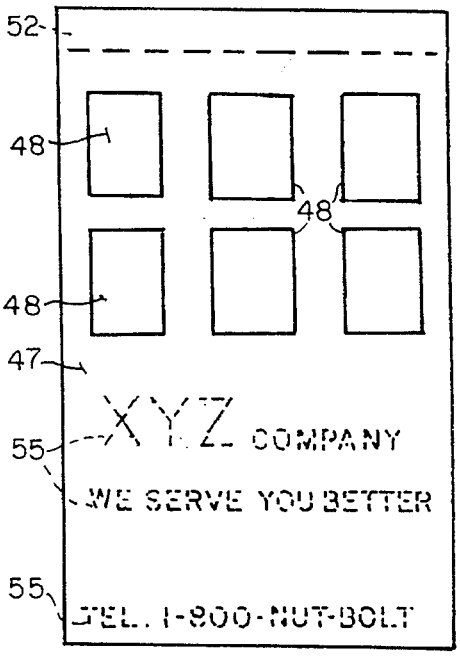
FIG. 9 is a view in front elevation of the package of FIGS. 7 and 8.

Referring now to FIGS. 7 and 9 for another embodiment, reference numeral 41 indicates a package including a backing 45 with a back surface 46 on which pads 42 of place marking tabs are mounted, but also a pad 43 of note-size sheets. The pads 42 can be replaced by another note-size pad 43, if desired. Tab or place marking pads 48 are mounted on a front surface 47 of the backing 45, in such a way as to leave a substantial space on which indicia 55 are printed.

An adhesive strip 51 extends along an upper margin of the backing 45, and is covered with a cover strip 52. Preferably, fold lines, not here shown, are formed below the adhesive strip, to facilitate the mounting of the strip to a surface. In the case of the adhesive 51, especially as it is used with the type of upper strips shown in FIG. 13, a strong adhesive, as distinguished from a peelable type, is useful.

Figure 10:
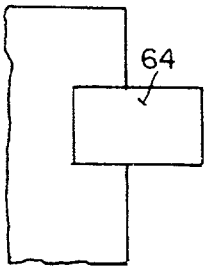
FIG. 10 is a fragmentary plan view of a page with a double tab adhered to one edge.
Figure 11:
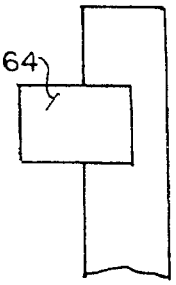
FIG. 11 is a fragmentary plan view of the opposite side of the page and tab shown in FIG. 10.
Figure 12:
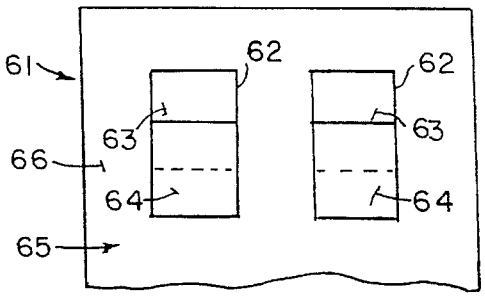
FIG. 12 is a fragmentary view in front elevation of yet another embodiment, showing a package of pads the sheets of which are serving as carriers for the double tabs shown in FIGS. 10 and 11.

Referring now to FIGS. 10, 11, and 12 for yet another embodiment, a package 61 is shown provided with pads 62 of sheets 63, which can be paper or plastic. In either event, the sheets 63 are coated with a silicon release agent below the usual adhesive strip. They serve as carriers for double tabs 64, which can be of plastic or cloth, with adhesive on facing surfaces of two legs of the tab. The tab 64 are mounted on edges of sheets, which can be pages of a book, documentary exhibits, or whatever such tabs are used for, as shown in FIGS. 10 and 11.

Figure 14:
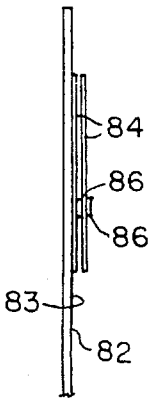
FIG. 14 is a view in edge elevation of the package shown in FIG. 15.
Figure 15:
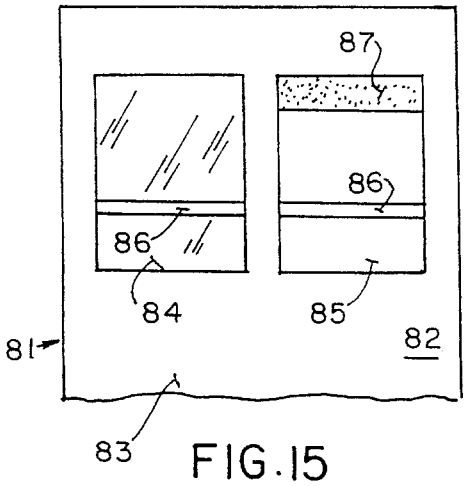
FIG. 15 is a fragmentary view in front elevation of a package in which the pads are made up of sheets of plastic material, the sheets on the left being transparent, those on the right, frosted along one edge to facilitate writing on them, and both shown with emphasis lines.

Referring now to FIGS. 14 and 15, a package 81 is shown as having a backing 83 on which pads 84 and 85 are mounted. The pad 84 is made up of transparent plastic sheets, with an emphasis line 86 on it, shown here as spaced from a bottom edge, merely for clarity. The line 86 can be anywhere on the sheet, although commonly it is along the lower edge. The line 86 can also take the form of an arrow or other sign, and can be oriented in any direction with respect to the sheet. The pad 85 is also made up of plastic sheets with the indicia line 86, but with a frosted area 87, of a surface that will accept pencil or pen marking. The area of the frosted part 87 can be enlarged to cover more or even all of the top surface of the sheet. As is the case with all of the pads of the various embodiments, the sheets of the pads have the usual peel-off permitting adhesive in a strip along the upper edges of the back surface of the sheets, by which they are adhered to one another, and with the bottom sheet, to the backing. If it is desired to do so, the bottom sheet can be adhered to the backing more nearly permanently by the application of a different kind of adhesive. The adhesive strip along the top edge of the backing sheet can be either of the peel-off type, or of a more permanent type.

In all of the embodiments, the package can be, and generally will be packed in a clear shrink wrap. Particularly in those cases in which the backing is sized to fit into a shirt pocket, a cover flap can be provided that extends over the pads, or a simple slip case can be provided.

The backing can be punched along one margin with as many holes as is appropriate, to adapt it to being mounted in a ring binder.

Numerous variations in the construction of the package of this invention, within the scope of the appended claims, will occur to those skilled in the art in the light of the foregoing disclosure. Merely by way of example, and not of limitation, the pads can be all of one color, or the sheets making up a pad may be of different colors. However, the arrangement described has advantages in ease of use, and in providing an easy way to distinguish subjects and the like. The shape of the backing can be varied, as heart shaped or shamrock shaped, and the pads themselves can be given different configurations, although the rectangular shape is easier to make and use. The pads can be arranged in decorative patterns different from the columns and rows illustrated. The backing can be of material other than paper, and be not self-supporting, although its being self-supporting is much preferred. Adhesive can be positioned in areas different from the upper edge of the backing and in different configurations; for example, a single strip in the center of the back surface of the backing, or a circular patch of adhesive, anywhere on the backing, or a plurality of strips or patches, each selectively exposable, can be provided to give the user a choice. Adhesive can also be positioned on both sides of the backing, either at the same end or opposite ends of the backing, particularly in the embodiment in which pads are mounted on both sides of the backing. Adhesive that must be moistened to adhere can be used, without provision for an overlying strip. These are merely illustrative.

Having thus described the invention what is claimed is:

1. A placemark peel pad package comprising a plurality of pads each made up of a multiplicity of peel-off sheets each of said sheets having an area of self-adhering adhesive extending in a strip on one broad face of said sheet adjacent an edge area thereof but covering less than the entire surface of said sheet, each of said sheets of each pad being selectively removeably and replaceably adhered to a contiguous sheet, all of said pads being mounted on a single backing, said backing having a broad front surface and a broad rear surface, said pads being mounted on said front surface, at least one strip of adhesive along said rear surface, whereby said backing with said pads mounted on it can be adhered to a surface, said strip of adhesive being located on an edge margin of said backing, and a line of perforations along the length of said strip of adhesive whereby said backing can be separated from said strip of adhesive by tearing along said line of perforations.

2. The package of claim 1 wherein sheets of any one of said pads are of one color throughout said pad but sheets of different pads are of different colors.

3. The package of claim 1 wherein said backing is a self-supporting sheet material.

4. The package of claim 1 wherein the strip of adhesive along an edge of said pads is of a width less than ½", and the width of each pad, less than ¾".

5. The package of claim 4 wherein a strip of adhesive along an edge of each sheet making up a pad is no more than ⅜".

6. The package of claim 1 wherein the pads are of different sizes.

7. The package of claim 1 wherein all adjacent pads are spaced from one another.

8. The package of claim 1 wherein pads are made up of sheets of flexible plastic film.

9. The package of claim 8 wherein said sheets are transparent.

10. The package of claim 8 wherein said sheets have frosted areas.

* * * * *